US005273480A

United States Patent [19]

Suto

[11] Patent Number: 5,273,480

[45] Date of Patent: Dec. 28, 1993

[54] CONTROL VEHICLE TOY DRIVE TRAIN FOR PIVOTING TURNS

[75] Inventor: Shohei Suto, Tokyo, Japan

[73] Assignee: Taiyo Kogyo Co., Ltd., Tokyo, Japan

[21] Appl. No.: 966,880

[22] Filed: Oct. 26, 1992

[30] Foreign Application Priority Data

May 28, 1992 [JP] Japan ..... 4-160045

[51] Int. Cl.[5] ..... A63H 30/04; A63H 17/14; A63H 29/00; B62D 6/00

[52] U.S. Cl. ..... 446/456; 446/433; 446/443; 446/460; 180/6.2; 180/638; 180/372; 24/354; 24/435; 24/665 GA

[58] Field of Search ..... 486/431, 433, 436, 437, 486/442, 443, 454, 456, 460, 461, 462, 463; 180/6.2, 6.32, 6.34, 6.36, 6.38, 372; 74/354, 355, 352, 384, 435, 665

[56] References Cited

U.S. PATENT DOCUMENTS

| | | | |
|---|---|---|---|
| 2,832,426 | 4/1958 | Seargeant | 446/433 X |
| 3,396,690 | 8/1968 | Tsunazawa | 180/6.2 |
| 3,540,152 | 11/1970 | Beny et al. | 446/433 |
| 4,112,615 | 9/1978 | Ishimoto | 446/456 |
| 4,577,528 | 3/1986 | Hanazawa | 74/384 X |
| 4,655,724 | 4/1987 | Law | 446/454 X |
| 4,878,877 | 11/1989 | Auer et al. | 74/354 X |
| 4,927,401 | 5/1990 | Sonesson | 446/433 X |

FOREIGN PATENT DOCUMENTS 294597 7/1990 Japan .

*Primary Examiner*—D. Neal Muir

*Attorney, Agent, or Firm*—Edward D. C. Bartlett

[57] ABSTRACT

A drive unit of a vehicle toy realizes a high-speed performance and a large-torque performance, is excellent in operability and provides improved battery life. In the drive unit, there is provided a motor gear driven by a radio-controlled motor, first and second drive gears for independently driving left-hand and right-hand wheels, first and second intermediate gears for causing the first and second drive gears to rotate at a lower speed, and an idler gear meshing with one of the intermediate gears to cause the first and second drive gears to rotate in opposite directions. A travelling gear assembly is rotatably driven by the motor gear to travel along a path between a forward position for forward vehicle toy drive and a turn position for vehicle toy turning, the travelling gear assembly directly driving the first and second drive gears in the forward position and driving the same gears through the first and second intermediate gears and the idler gear in the turn position.

13 Claims, 11 Drawing Sheets

D
44
58
59b
F
R
B
80
48
A

CONTROL VEHICLE TOY DRIVE TRAIN FOR PIVOTING TURNS

BACKGROUND OF THE INVENTION

1. Field of the Invention

The present invention relates to a drive unit for driving wheels of a vehicle toy, and more particularly to a drive unit for controlling, in travelling, a vehicle toy such as tanks provided with caterpillars and like vehicles.

2. Description of the Prior Art

In conventional remote-controlled vehicle toys, there are known vehicle toys such as tanks (war vehicles) provided with caterpillars (such as endless tracks and the like) and like vehicles. Since this vehicle toy travels by means of caterpillars running round front left-hand/-right-hand and rear left-hand/right-hand wheels, a ground contact area of the vehicle is large to substantially prevent the vehicle from being stuck, and, therefore enable the same to perform off-road travelling on sands, grasslands and the like. Such vehicle toy provided with the caterpillars is provided with a drive mechanism for driving a left-hand and a right-hand wheel, respectively, and uses a zero turning radius system which uses a difference in rotation between the caterpillars when the vehicle makes a turn by having the left-hand and the right-hand rear wheel rotate in directions opposite to each other.

Since the conventional vehicle toy provided with the caterpillars drives its caterpillars, the vehicle has a large ground contact area resulting in a large frictional resistance. Particularly, when the vehicle makes a turn, a load on the vehicle becomes very large. Due to this, for example, even when the vehicle uses a high-performance motor and a high-power nickel-cadmium battery and the like, it suffers from poor torque when the vehicle employs a low gear ratio to realize a high-speed performance. On the other hand, when the vehicle employs a high gear ratio to realize a large-torque performance, it suffers from poor speed. Namely, in the conventional caterpillar vehicle toy, it is difficult to realize an adequate performance having high-speed performance and large-torque performance both compatible with each other. Further, should both high-speed and large-torque performances be simultaneously realized, the battery life would be extremely reduced, which would be very disadvantageous.

SUMMARY OF THE INVENTION

It is an object of the preferred embodiments of the present invention to provide a drive unit of a vehicle toy which makes it possible to have high-speed performance and large-torque performance compatible with each other.

It is a further object of the preferred embodiments of the invention to provide excellent operability, and to improve battery life.

According to one aspect of the present invention there is provided a drive unit of a vehicle toy having a motor gear driven by a radio-controlled motor, first and second drive gears for independently driving a left wheel and a right wheel, respectively, first and second intermediate gears for reducing respectively the rotational speed of the first and second drive gears, and an idler gear meshed with the first or the second intermediate gear to have the first and second drive gear be driven in directions opposite to each other. A travelling gear is rotatably driven by the motor gear to travel along a path between a forward-drive position and a turn-drive position depending on the rotational direction of the motor, the travelling gear directly driving both the first and second drive gears in the forward-drive position and driving the same gears through the first and second intermediate gears and also the idler gear in the turning or turn-drive position.

Further, in another embodiment of the present invention, a rack which can mesh with the travelling gear is disposed in an intermediate position between the forward-drive and the turn-drive positions.

According to a preferred aspect of the present invention, the travelling gear while meshed with the motor gear: (i) travels along a path between the forward-drive position and the turn-drive position, depending on the rotational direction of the motor; (ii) meshes with the first and second drive gears in the forward-drive position to directly drive the same gears; and (iii) meshes with the first and second drive gears through the first and second intermediate gears and the idler gear in the turn-drive position to have the first and second drive gears be rotatably driven in directions opposite to each other respectively, so that the reduction gear ratio is increased by means of the first and second intermediate gears which make it possible for the reduction gear ratio in the turn-drive position to become larger than that in the forward-drive position, whereby it is possible to realize high-speed performance in forward driving conditions and large-torque performance in turn conditions, and thereby enhancing operability and allowing the battery to have a longer life.

Further, by disposing the rack (which is meshed with the travelling gear) in the intermediate position between the forward-drive position and the turn-drive position, it is possible to forcibly move the travelling gear even when it is in a neutral condition, whereby the gears can be meshed without fail.

According to another aspect of the invention, there is provided a radio-controlled, battery-operated vehicle toy comprising a reversible electric motor having a motor gear rotatable about an axis, and right side and left side wheels independently driven by the motor via gearing; The gearing includes a travelling gear in mesh with the motor gear and movable around the motor gear along an arcuate path concentric with said axis. The travelling gear is driven along said path between a forward-drive position and a turn-drive position by the motor gear in dependence upon the direction of rotation of the reversible motor. The right side and left side wheels are rotated in the same direction via the gearing when the travelling gear is in the forward-drive position, and the right side and left side wheels are rotated in opposite directions via the gearing when the travelling gear is in the turn-drive position.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Figure 1:
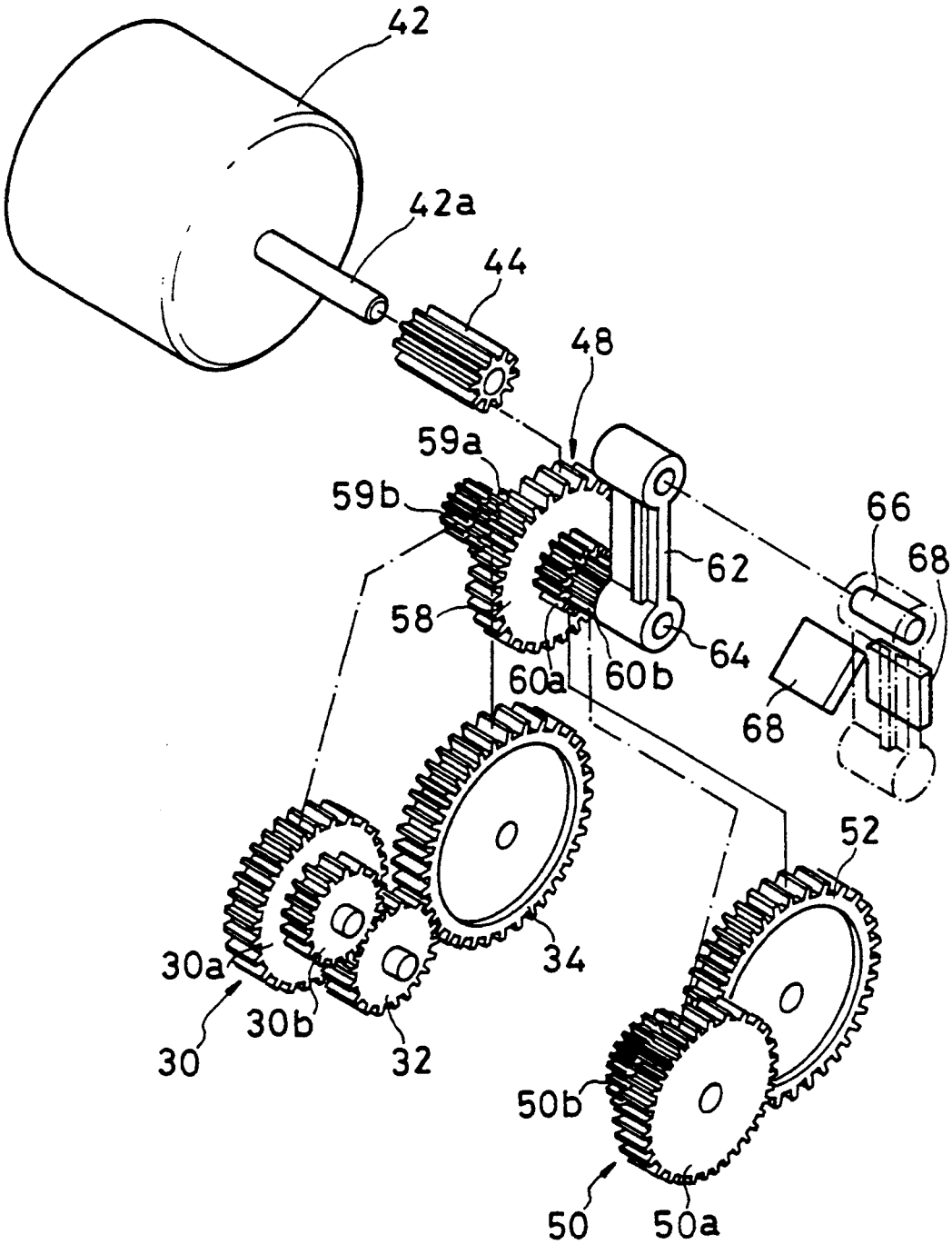
FIG. 1 is an exploded perspective view of the working parts of the drive unit of a first embodiment of the present invention, indicating the alternative meshing conditions of the gears of the unit.
Figure 2:
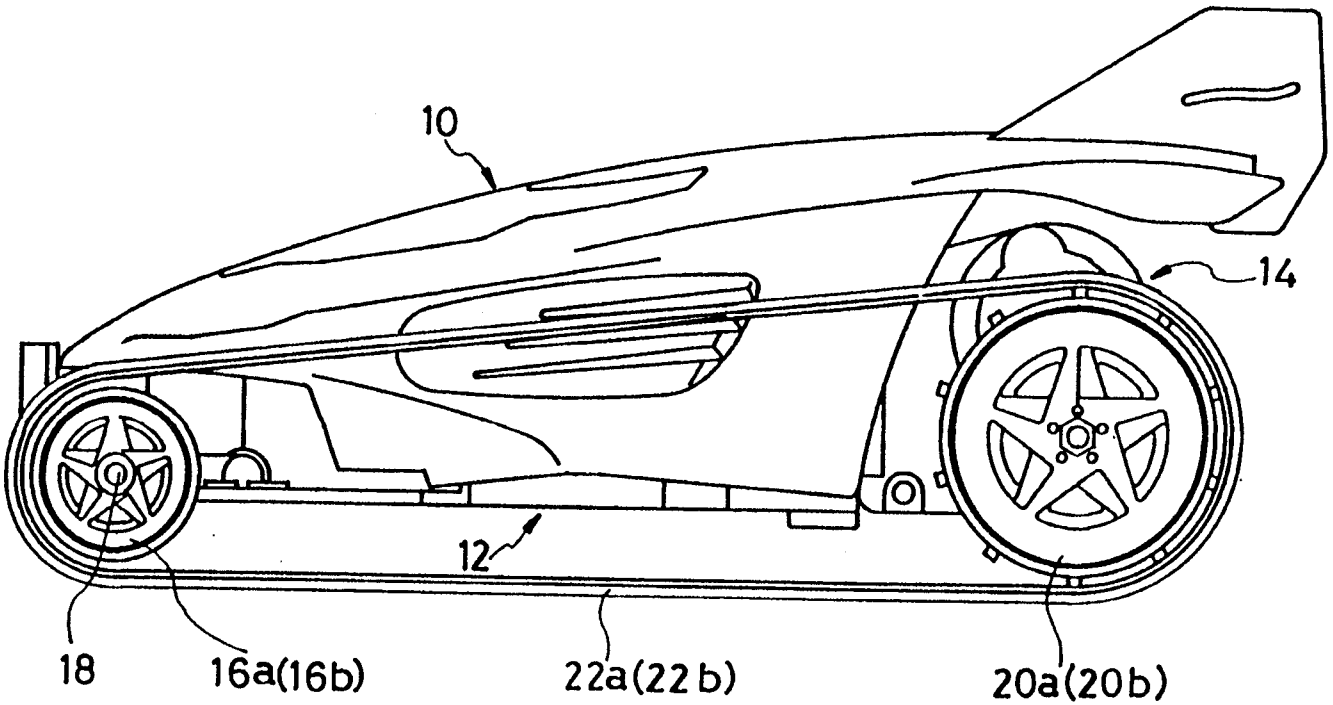
FIG. 2 is a left side view of a vehicle toy of the present invention embodying the drive unit of FIG. 1.
Figure 3:
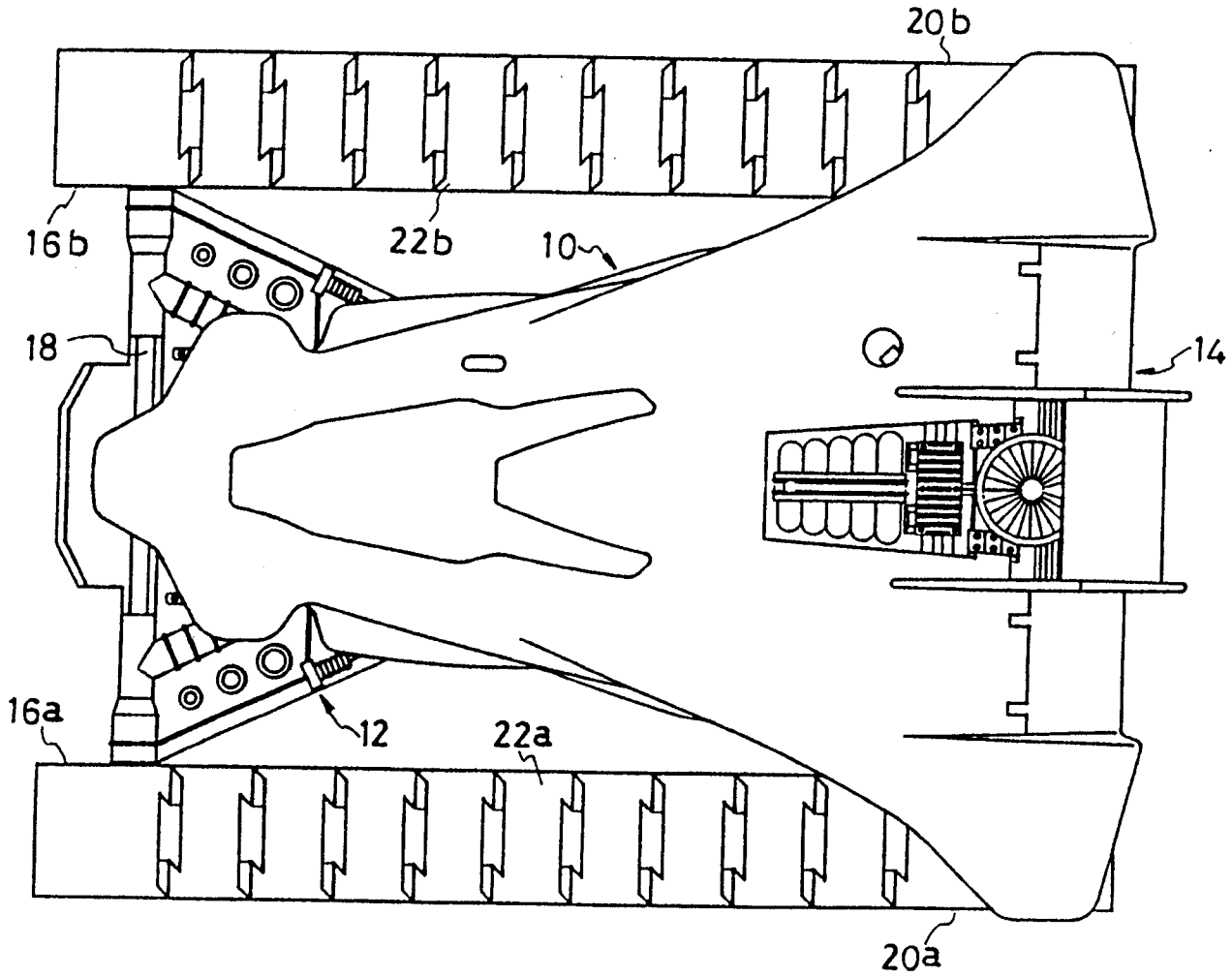
FIG. 3 is a plan view of the vehicle toy of FIG. 2.
Figure 4:
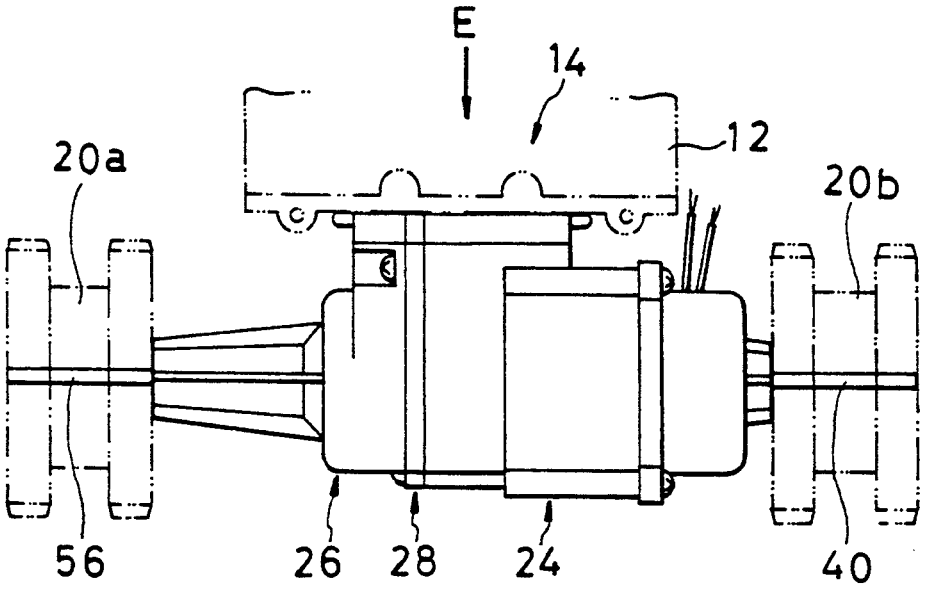
FIG. 4 is a plan view of the drive unit of FIG. 1.
Figure 5:
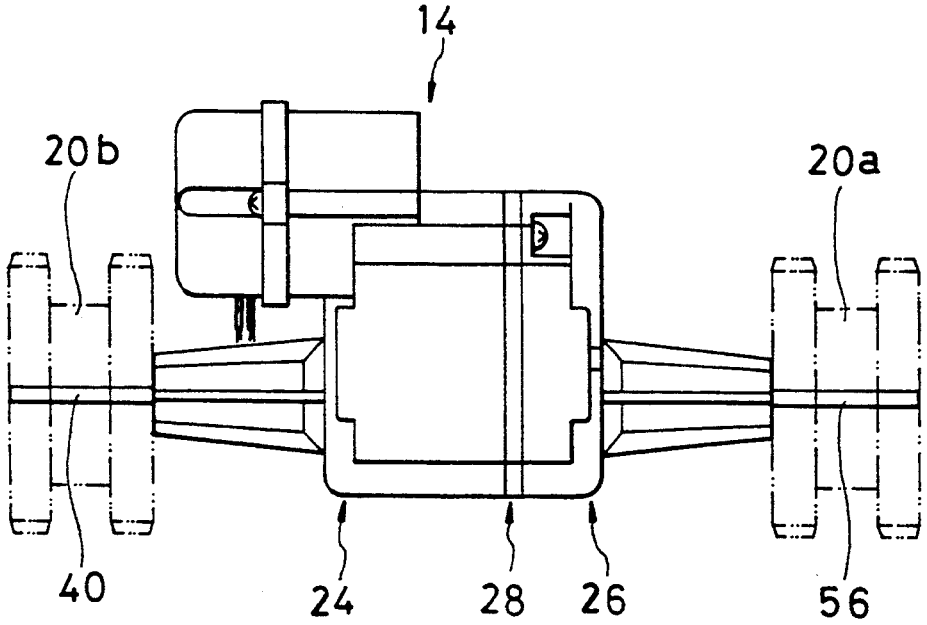
FIG. 5 is a front view of the drive unit of FIG. 4, looking in the direction of the arrow E in FIG. 4.

The present invention will first be described with reference to the embodiment thereof shown in FIGS. 1 to 14 in which FIG. 2 is a side view of a radio-controlled, battery-operated vehicle toy of the present invention, and FIG. 3 is a plan view of this vehicle toy. Thereafter, the further embodiment illustrated in FIGS. 15 to 17 will be described.

The toy vehicle has a front, a rear, a right-hand side and a left-hand side In FIGS. 2 and 3, the front is to the left and the rear is to the right. In FIG. 3, the right-hand side is to the top, and the left-hand side is to the bottom; whereas in FIG. 6, the right-hand side is to the left top corner, and the left-hand side is to the bottom right corner.

The vehicle toy is provided with a body 10 which forms an upper vehicle body made of molded plastics or the like. A chassis portion 12/forms a lower vehicle body and is also made of molded plastics or the like and supports the upper body portion 10. The body 10 and the chassis portion 12 are so formed as a whole as to simulate in shape a real vehicle, such as a car or the like, for travelling at high-speed. Contained in the interior thereof is an electric motor 42, a printed circuit board having a receiving circuit of a radio control, and a battery for supplying electric power to the receiving circuit and the motor 42. The motor 42 is reversible, and is radio controlled by a radio transmitter located remote from the vehicle toy and controlled by an operator The operator can stop and start the motor, and cause the motor to rotate in either direction of rotation. In a rear portion of this chassis portion 12, there is provided a drive unit 14 which includes the motor 42 and a transmission mechanism to be described later. A front left-hand wheel **16*a* and a front right-hand wheel 16*b* are rotatably mounted respectively on a left and a right end portion of a front axle shaft 18 provided in a front portion of the chassis portion 12. A rear left-hand wheel 20*a* and a rear right-hand wheel 20*b* are mounted respectively on an end portion of a left-hand drive shaft 56 and an end portion of a right-hand drive shaft 40. The shafts 56, 40 extend from left and right side surfaces of the drive unit 14, respectively. A left-hand 22*a* and a right-hand 22*b* caterpillar or endless track, made for example of rubber or the like, are respectively trained around and run around the front and rear left-hand wheels 16*a*, 20*a* and the front and rear right-hand wheels 16*b*, 20*b*** as shown in FIGS. 2 and 3.

As shown in FIGS. 4 to 10, the drive unit 14 has a mechanism in which a torque developed in a radio-controlled power source or motor 42 is transmitted to left-hand and right-hand gear trains which each have their final drive gear as a separate power output The right-hand drive unit casing 24 contains the motor 42 and the gears for driving the rear right-hand wheel **20*b*. The left-hand drive unit casing 26 contains the gears and the like for driving the rear left-hand wheel 20*a*. A casing spacer 28 is interposed between the casings 24 and 26**.

Figure 6:
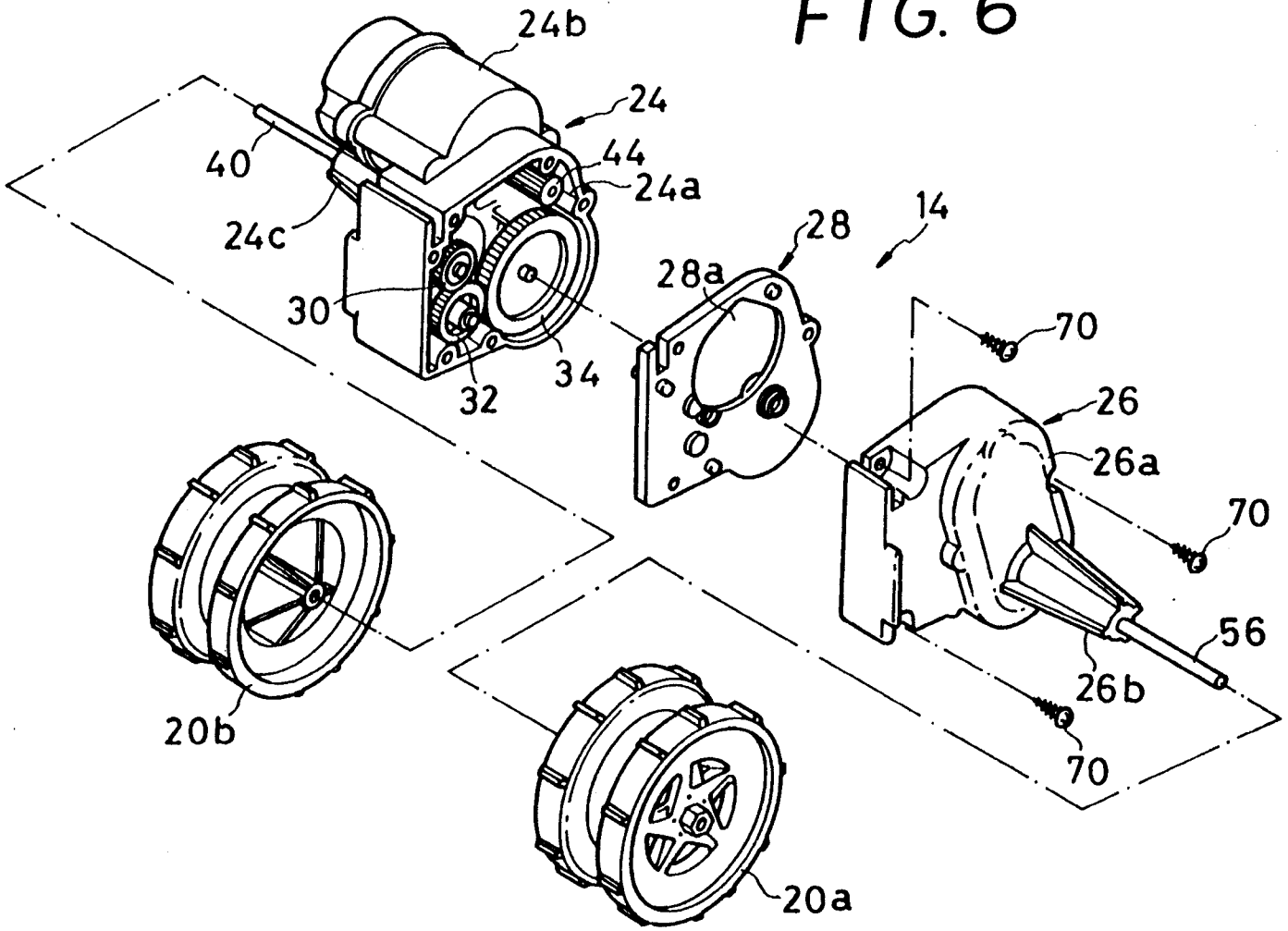
FIG. 6 is an exploded perspective view of the above drive unit.
Figure 7:
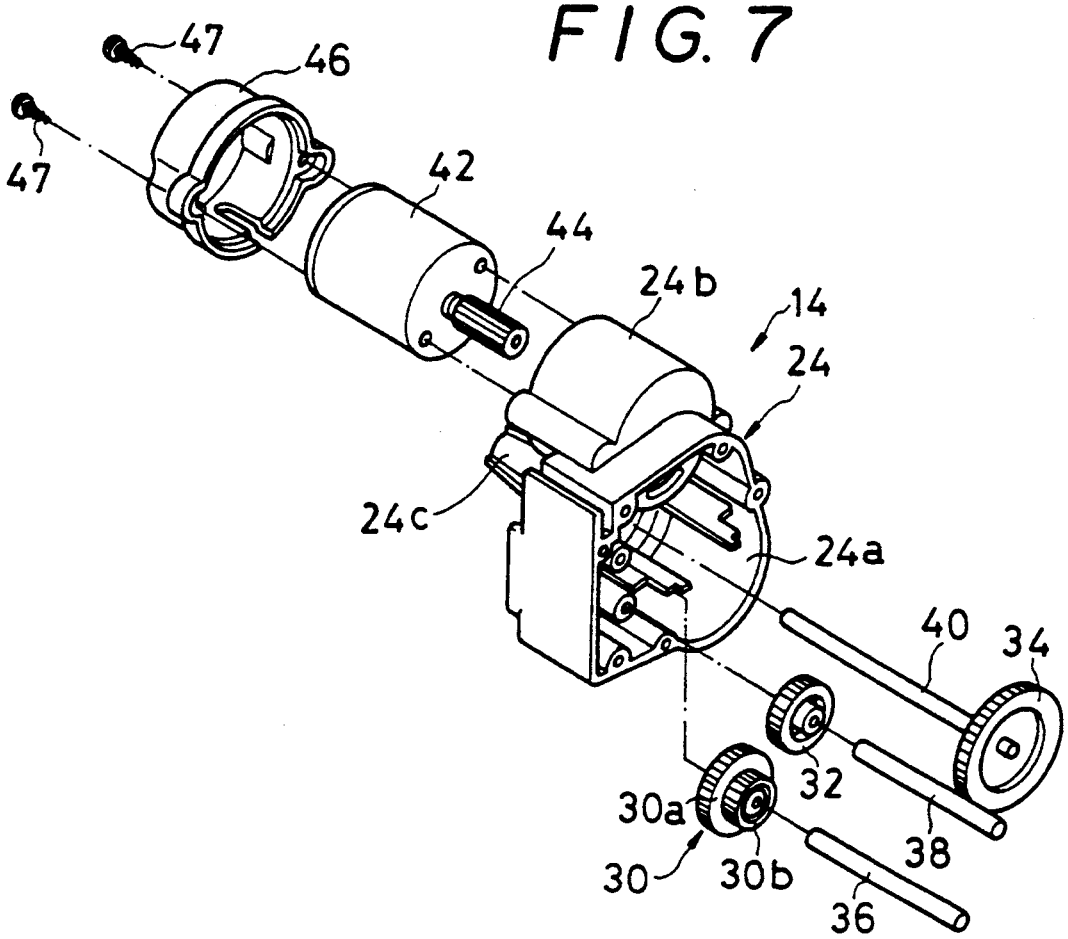
FIG. 7 is an exploded perspective view of the motor and the gears in the right-hand casing of the drive unit shown in FIG. 6.
Figure 8:
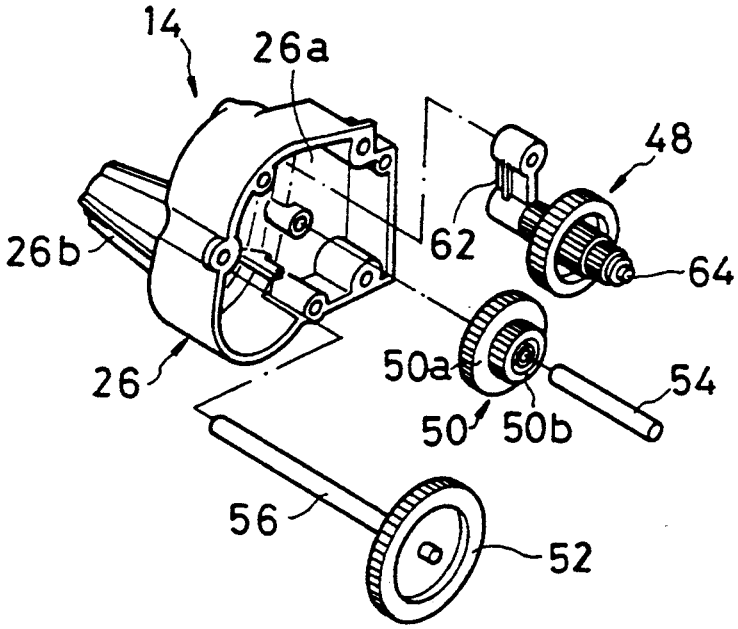
FIG. 8 is an exploded perspective view of the gears in the left-hand casing of the drive unit shown in FIG. 6, but turned through 180 degrees from the orientation in FIG. 6.

Integrally formed with the right-hand casing 24 are a gear housing portion **24*a* which is open at the left side, a motor housing portion 24*b* formed in an upper portion of this gear housing portion 24*a*, and a shaft guide portion 24*c* horizontally extending rightward from the right side of the gear housing portion 24*a*. In the portion 24*a*, there are disposed a first intermediate gear 30, an idler gear 32, and a first drive gear 34. As shown in FIG. 1, the first intermediate gear 30 is constructed of a large-diameter gear 30*a* with a large number of teeth and a small-diameter gear 30*b* with a smaller number of teeth, the gears 30*a*, 30*b* being coaxially and integrally formed. The first intermediate gear 30 and the idler gear 32 are rotatably mounted on shafts 36 and 38, respectively. The shafts 36, 38 each have an end portion fixedly mounted in a separate boss integrally formed with an inner wall of the gear housing portion 24*a* in projecting manner. The first drive gear 34 is fixedly mounted on an end portion of the drive shaft 40, the other end portion (right-hand end portion) which horizontally extends rightward to have the rear right-hand wheel 20*b* fixedly mounted on the extended end portion, as indicated in FIG. 6. The other end portions (left-hand end portions) of the shafts 36, 38 and of the drive shaft 40 are rotatably supported on bearing portions of the casing spacer 28, the bearing portions being formed in positions corresponding to those of the left-hand end portions of these shafts 36, 38, 40. As is clear from FIGS. 1 and 7, the motor 42 has the motor gear 44 fixedly mounted on its output shaft 42*a*, and is received in the motor housing portion 24*b* in a manner such that the motor gear 44 looks toward an inside of the gear housing portion 24*a*. A cover 46** (FIG. 7) is mounted on a right-hand opening portion of the motor housing portion 24*b* by means of screws 47 or like fasteners. Incidentally, meshing conditions of the gears will be described later.

Figure 9:
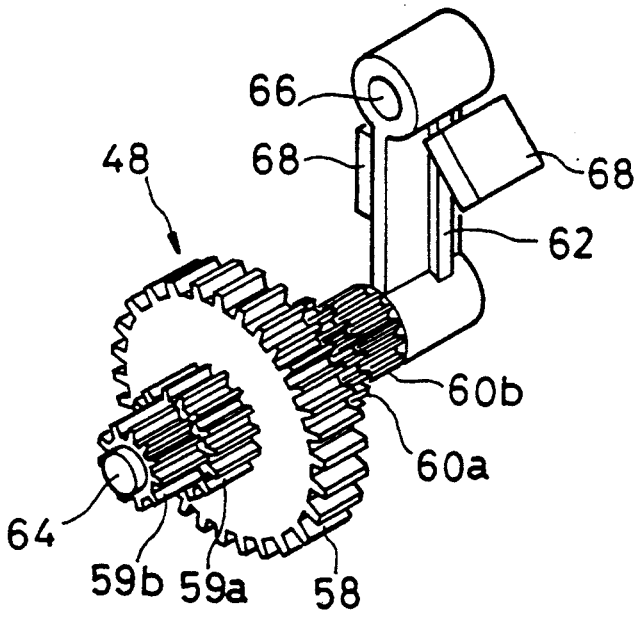
FIG. 9 is a perspective view of the travelling gear portion of the above drive unit illustrating the mounting of the travelling gear assembly.

Integrally formed with the left-hand casing 26 are a gear housing portion 26*a* which is open at one side (right-hand side) and a shaft guide portion 26*b* horizontally extending leftward from the left-hand side of this gear housing portion 26*a*. In this gear housing portion 26*a*, there are disposed a travelling gear 48, a second intermediate 50 and a second drive gear 52. The second intermediate gear 50 is constructed of a large-diameter gear 50*a* with a large number of teeth and a small-diameter gear 50*b* with a small number of teeth, the gears 50*a*, 50*b* being coaxially and integrally formed. The second intermediate gear 50 is rotatably mounted on a shaft 54 which has one end fixedly mounted in a boss of the gear housing portion 26*a*, the boss being so formed on an inner wall of the gear housing portion 26*a* as to extend rightward from the inner wall. The second drive gear 52 is fixedly mounted on one end portion of the drive shaft 56. The other end portions (right end portions) of these shafts 54, 56 are rotatably supported in bearing portions of the casing spacer 28 (FIG. 6), these bearing portions being formed in positions corresponding to those of the right end portions of these shafts 54, 56. The travelling gear 48 is constructed of a planetary gear 58, two first travelling gears 59*a*, 59*b*, and two second travelling gears 60*a*, 60*b*. The planetary gear 58 travels in mesh with the motor gear 44. The two first travelling gears 59*a*, 59*b* are of different sizes and are coaxially and integrally formed with the planetary gear 58 at one side of the gear 58. The gears 59*a* and 59*b* are both smaller than the gear 58 with the gear 59*a* being larger than the small gear 59*b*. The two second travelling gears 60*a*, 60*b* are likewise of different sizes, are also coaxially and integrally formed with the planetary gear 58 but at the other side thereof, with the gear 60*a* being larger in diameter than the gear 60*b*, as shown in FIG. 9. The travelling gear 48, or more accurately the travelling gear assembly 48, is rotatably mounted on a shaft 64 which is horizontally fixedly mounted on a free end portion of an arm 62. The other end portion of the arm 62 is rotatably mounted on a shaft 66 mounted in an inner wall of the left-hand casing 26 in projecting manner so as to be coaxial with the motor gear 44. Further, as is clear from FIGS. 9 and 10, the arm 62 is so arranged as to be swingable between a vertical line A and an obliquely inclined line B inclined at an angle of, for example, about 38 degrees relative to the vertical line A. The lines A, B are defined respectively by stops 68 formed on an inner wall of the left-hand casing 26.

As is clear from FIG. 6, the casing spacer 28 is so formed as to cover the opening areas of both the right-hand casing 24 and the left-hand casing 26. In opposite side surfaces of the spacer 28, there are formed the bearing portions for supporting the other end portions of the above-mentioned shafts. A central opening 28*a* in the spacer 28 is sized to permit both the motor gear 44 and the travelling gear assembly 48 (which is swingable about the motor gear 44) not to contact the spacer 28. As shown in FIG. 6, when assembling, the right-hand casing 24 containing the motor 42, and the gears therein and the left-hand casing 26 containing the gears, have their opening portions looking towards each other with the spacer 28 interposed therebetween, and then are fixed to each other by means of screws 70 or like fasteners.

FIG. 1 is a perspective view illustrating the meshing conditions of the gears of the drive unit. The motor gear 44, fixedly mounted on the motor output shaft 42*a* looks toward the opening portion 28*a* (FIG. 6) of the casing spacer 28 from the open side of the right-hand casing 24. The gear 44 meshes with the planetary gear 58 of the travelling gear assembly 48. The travelling gear assembly 48 is also rotatably accommodated in the open side of the left-hand casing 26. Since the travelling gear assembly 48 is pivotal about the shaft 66 coaxial with the motor gear 44, the gear assembly 48 is swingable with the planetary gear 58 always in mesh with the motor gear 44. The travelling assembly gear 48 has its first larger diameter travelling gear 59*a* directly meshed with the first drive gear 34 when the arm 62 abuts one of the stops 68 so as to be positioned on the vertical line A at a position F as shown in FIG. 10; at the same time, the travelling gear 48 has its second larger diameter travelling gear 60*a* directly in mesh with the second drive gear 52.

Figure 10:
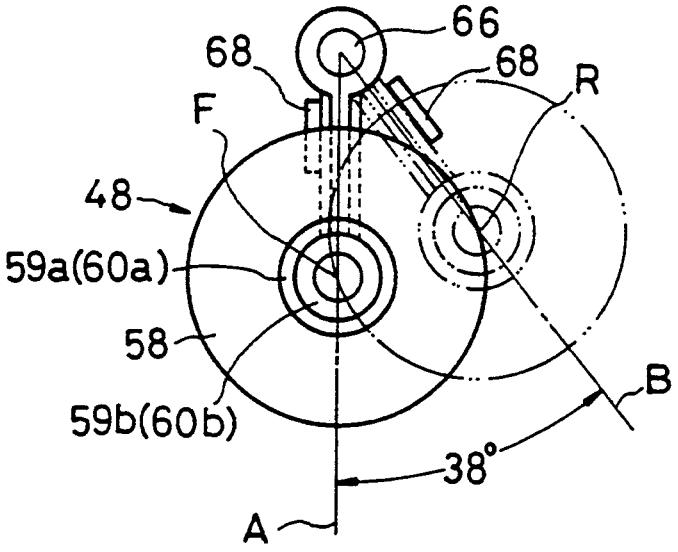
FIG. 10 is a side view, from the right side, of the travelling gear portion of the above drive unit illustrating the shifting of the travelling gear assembly between two operating positions.

On the other hand, when the arm 62 is pivoted to abut the other stop 68 so as to be positioned on the oblique line B at a position R thereon as shown in FIG. 10, the travelling gear assembly 48 has its first smaller diameter travelling gear 59*b* in mesh with the large-diameter gear 30*a* of the first intermediate gear 30, and at the same time the second smaller diameter travelling gear 60*b* meshes with the large-diameter gear 50*a* of the second intermediate gear 50. Further, the small-diameter gear 30*b*, with the smallest number of teeth of the first intermediate gear 30, is meshed with the first drive gear 34 through the idler gear 32, and the small-diameter gear 50*b* of the second intermediate gear 50 is directly meshed with the second drive gear 52.

Thus, when an axis of the travelling gear assembly 48 is positioned on the vertical line A at the position F, the torque developed in the motor 42 is transmitted to the planetary gear 58 of the travelling gear assembly 48 through the motor gear 44, and then at this point split into two parts, one of the two parts being directly transmitted to the first drive gear 34 through the first travelling gear 59*a*, and the other of the two parts being directly transmitted to the second drive gear 52 through the second travelling gear 60*a*.

On the other hand, when the axis of the travelling gear assembly 48 is positioned on the oblique line B at the position R, the torque developed in the motor 42 is transmitted to the planetary gear 58 of the travelling gear assembly 48 through the motor gear 44, and then at this point split into two parts. One of these two parts is transmitted to the first drive gear 34 through the first travelling gear 59*b*, large-diameter gear 30*a*, small-diameter gear 30*b* and the idler gear 32. The other of the two parts is directly transmitted to the second drive gear 52 through the second travelling gear 60*b*, large-diameter gear 50*a* and the small-diameter gear 50*b*.

In the embodiment of the present invention described above, a preferred number of teeth of the gears are, for example, as follows: 8 teeth for the motor gear 44; 32 teeth for the planetary gear 58; 12 teeth for each of the first and the second larger travelling gears 59*a*, 60*a*; 8 teeth for each of the first and the second smaller travelling gears 59*b*, 60*b*; 32 teeth for each of the first and the second intermediate gears 30*a*, 50*a*; 17 teeth for each of the first and the second smaller intermediate gears 30*b*, 50*b*; 21 teeth for the idler gear 32; and 42 teeth for each of the first and the second drive gears 34, 52.

Figure 11:
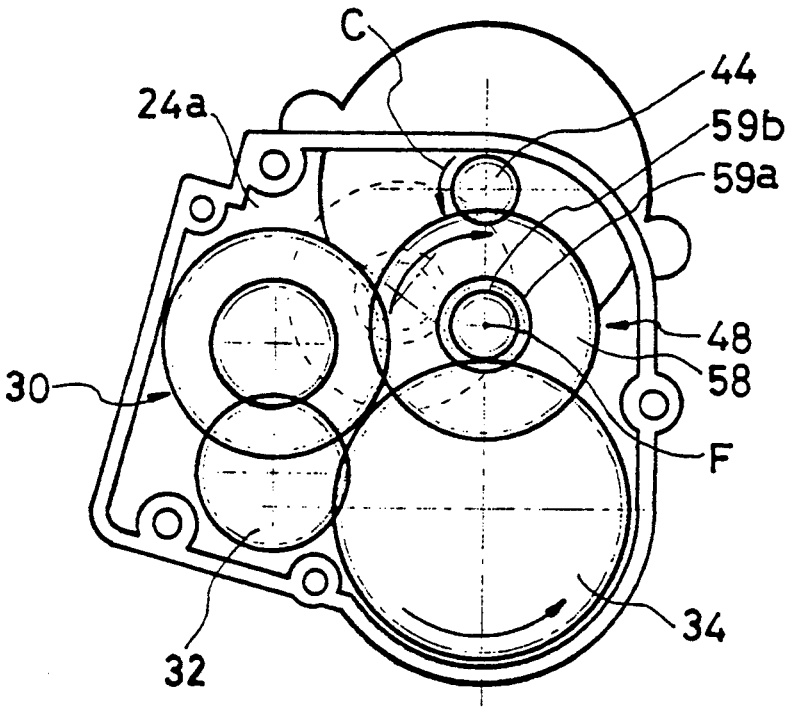
FIG. 11 is a side view, from the left side, of the drive unit illustrating the meshing of gears for driving the right-hand wheel in the forward direction.
Figure 12:
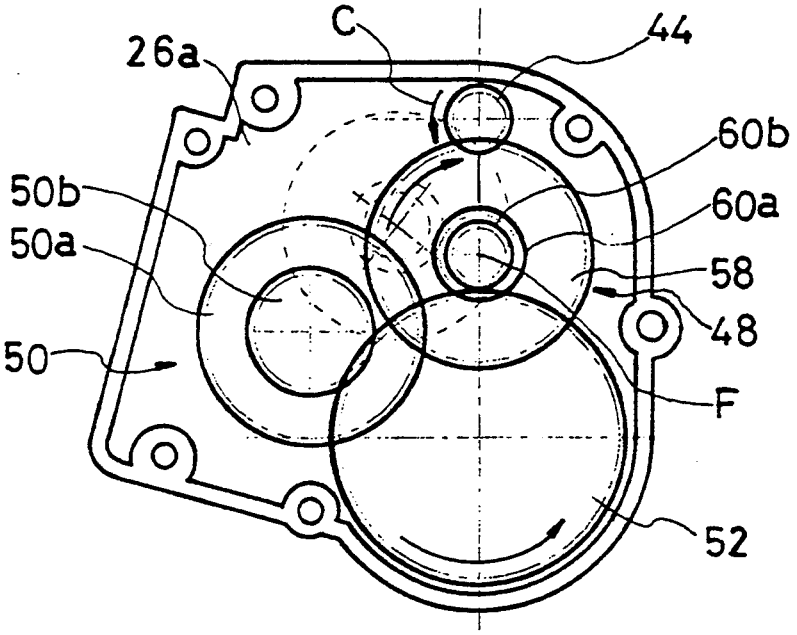
FIG. 12 is a side view, from the left side, of the drive unit illustrating the meshing of gears for driving the left-hand wheel in the forward driving direction.
Figure 13:
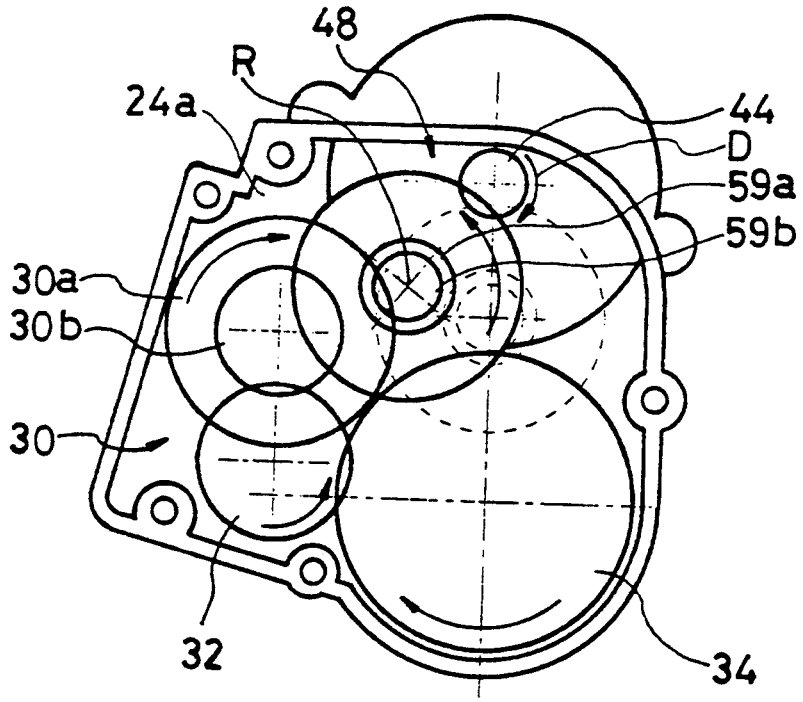
FIG. 13 is a side view illustrating meshing of the gears for driving the right-hand wheel in a turning operation of the vehicle toy.
Figure 14:
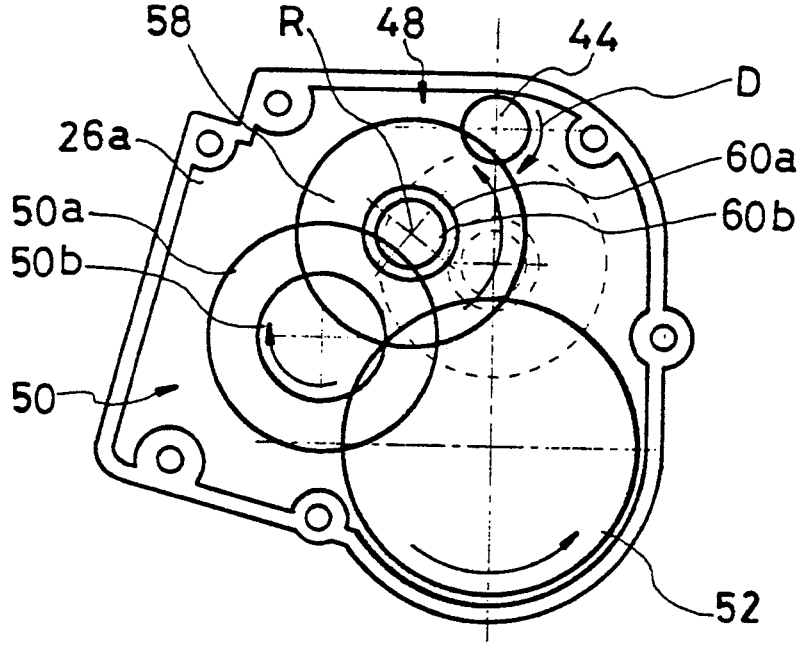
FIG. 14 is a side view of the meshing of the gears for driving the left-hand wheel in the turning operation.

Now, the drive unit of the above embodiment will be described in operation. FIGS. 11 and 12 illustrate the meshing conditions of the gears for driving the rear right-hand wheel and the rear left-hand wheel, respectively, in forward driving. FIGS. 13 and 14 illustrate the meshing conditions of the gears for driving the rear right-hand wheel and the rear left-hand wheel, respectively, during a turning operation Incidentally, all of these drawings show the meshing conditions of the gears as viewed from the left-hand side, i.e. the side of the rear left-hand wheel 20*a*.

As shown in FIGS. 11 and 12, when the motor gear 44 driven by the motor 42 rotates in a direction indicated by arrow C, i.e. counterclockwise in the drawings, the axis of the planetary gear 58 is moved to a forward position, i.e. position F on the vertical line A (shown in FIG. 10) under the influence of the torque exerted by the motor gear 44, so that the large-diameter gears 59*a* and 60*a* (each of which has the large number of teeth) are directly meshed with the first drive gear 34 and the second drive gear 52, respectively. In this forward position F, the travelling gear assembly 48 is restricted in movement because the pivotal arm 62 abuts against one of the stops 68. Consequently, the torque developed in the motor 42 is sequentially transmitted to the motor gear 44, planetary gear 58, travelling gears 59*a* and 60*a*, and the first and second drive gears 34, 52 to have these drive gears 34, 52 rotate in the same direction. The torque of the first 34 and second 52 drive gears is transmitted to the rear right-hand wheel 20*b* and the rear left-hand wheel 20*a* through the drive shafts 40 and 56, respectively, so that both the left-hand 22*a* and right-hand 22*b* caterpillars are driven in the same forward direction. The reduction ratio of the gears in this forward driving mode is 1/14 in the embodiment of the invention described above. Position F on line A represents the forward-drive position.

As shown in FIGS. 13 and 14, when the motor gear 44 driven by the motor 42 rotates in a direction indicated by arrow D, i.e. clockwise in the drawings, a central axis of the planetary gear 58 is moved to a turn position, i.e. position R on the oblique line B (shown in FIG. 10) under the influence of the torque exerted by this motor gear 44, so that the travelling gears 59*b* and 60*b* are meshed with the first and the second intermediate gears 30*a* and 50*a*, respectively. In this turn position R, the travelling gear assembly 48 is restricted in movement because the arm 62 abuts against the other of the stops 68. Consequently, the torque developed in the motor 42 is transmitted to the motor gear 44, the planetary gear 58, and the travelling gears 59*b* and 60*b* having the small number of teeth. Further, one of the split parts of the torque is sequentially transmitted to the large-diameter gear 30*a*, the small-diameter gear 30*b*, idler gear 32, and the first drive gear 34. While the other of the split parts of the torque is sequentially transmitted to the large-diameter gear 50*a*, the small-diameter gear 50*b*, and the second drive gear 52, whereby the second drive gear 52 is rotated in a direction opposite to that of the first drive gear 34. As is clear from FIG. 6, torque of the first drive gear 34 and the second drive gear 52 is transmitted to the rear right-hand wheel 20*b* and the rear left-hand wheel 20*b* through the drive shafts 40 and 56, respectively, so that the left-hand 22*b* and the right-hand 22*a* caterpillars are driven in directions opposite to each other so causing the vehicle toy to make a right turn on the spot where it stands. The reduction gear ratio in this on-the-spot turning mode is 1/39.5 in the embodiment of the present invention described above. Position R on line B represents the turn-drive position.

In the above construction, when the motor 44 is rotated in the forward direction, the travelling gear assembly 48 is directly meshed with the first and the second drive gears 34, 52 under the influence of the torque exerted by the motor gear 44 on the planetary gear 58, so that the drive gears 34, 52 rotate in the same direction. On the other hand, when the motor 44 is rotated in the reverse direction to effect the turning mode, the travelling gear assembly 48 is meshed with the first and second intermediate gears 30, 50 under the influence of the torque exerted by the motor gear 44 on the travelling gear assembly 48, and with the gear 30 meshed with the idler gear 32, the first drive gear 34 is rotated in a direction opposite to that of the second drive gear 52. Consequently, when the vehicle toy makes a turn, it is possible for the vehicle toy to increase the reduction ratio of the drive unit by means of the first and the second intermediate gears 30 and 50, thus making it possible to effect a turn with the reduction gear ratio higher than that used in the forward driving. Because of the above, it is possible for the vehicle toy to increase the reduction ratio of the drive unit so as to obtain a large torque withstanding a turn load (which is a problem for conventional vehicle toys provided with caterpillars), whereby the driving power can be effectively transmitted to the left-hand caterpillar 22*a* and the right-hand 22*a* caterpillar. At the same time, by reducing the turn speed with the increased reduction ratio, it is possible for the vehicle toy to improve its performance in directionality and in operability. In addition, it is possible for the vehicle toy to improve its battery life. Although the conventional vehicle toy provided with caterpillars exclusively uses a nickel-cadmium battery in general, by using the transmission mechanism of this new drive unit 14, it is possible for the vehicle toy of the present invention to realize a more powerful performance with the use of the nickel-cadmium battery and also possibly to enjoy a sufficient performance even when a manganese battery is used. Further, in the embodiment of the present invention described above, by simply controlling the motor 44 so as to rotate in a forward direction, rotate in the reverse direction, and to stop, it is possible to control the vehicle toy to move forward, make a turn, and stop, respectively. In the radio-controlled transmitter for the vehicle toy, it is possible to perform all controls of the vehicle toy by operating a single lever, which makes it possible to simplify the transmitter circuit and the vehicle toy receiver circuit Further, it is possible to eliminate a special steering mechanism for the vehicle toy so simplifying the toy in mechanism.

Figure 15:
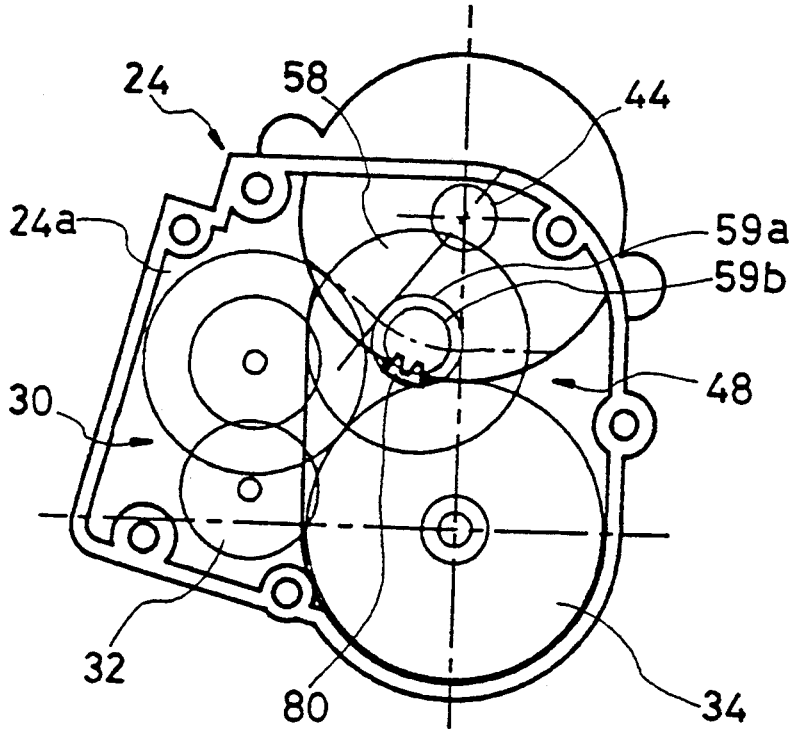
FIG. 15 is a side view of the drive unit of another embodiment of the present invention.
Figure 16:
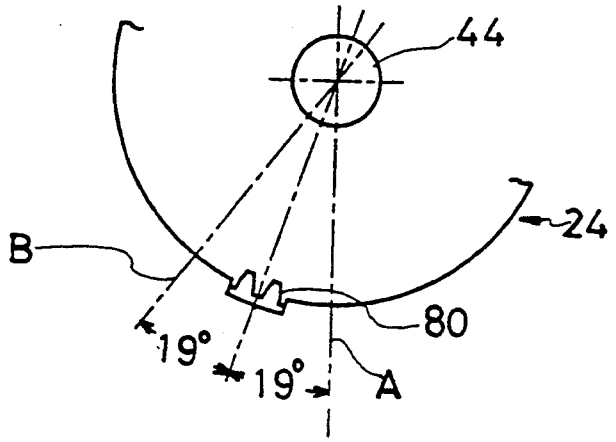
FIG. 16 is a partial side view, on a larger scale, of a rack of the drive unit of FIG. 15.
Figures 17A, 17B, 17C:
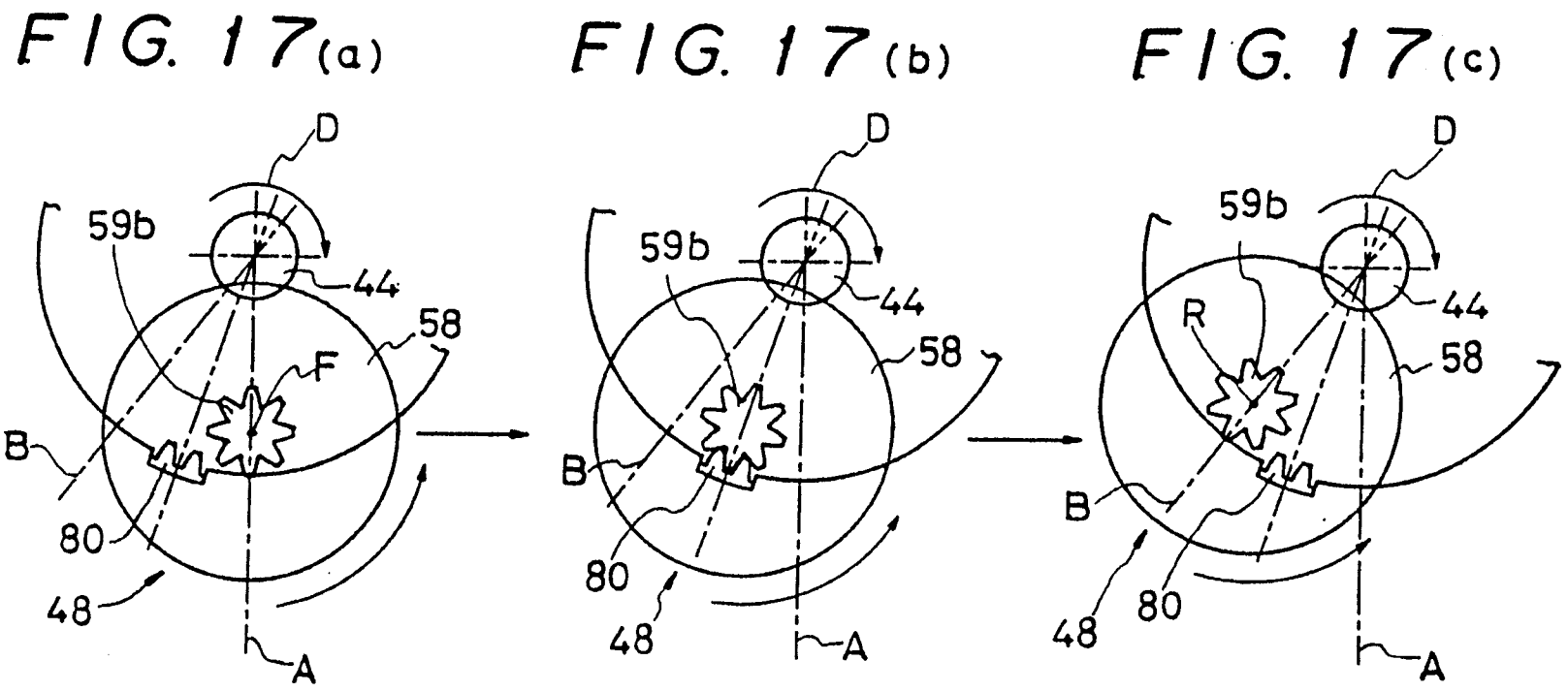
FIGS. 17(*a*), 17(*b*) and 17(*c*) are partial side views of the rack of the drive unit of FIGS. 15 and 16 illustrating a gear shifting operation starting from the forward driving condition through a neutral condition to the vehicle turning condition.

FIG. 15 illustrates the drive unit of another embodiment of the present invention. FIG. 16 illustrates the details of a rack portion of the drive unit of FIG. 15, and FIG. 17 represents sequential steps in changing from forward drive to turn. Parts corresponding to those of the above-described embodiment are denoted by the same reference characters.

FIGS. 15 and 16 show a neutral position in which the travelling gear assembly 48 is not meshed with any gears when the travelling gear assembly 48 travels in a path between the forward position and the turn position. There is provided a rack 80 which meshes with any one of the gears of the travelling gear assembly 48, for example such as the planetary gear 58, or any one of the travelling gears 59*a*, 59*b*, 60*a* and 60*b*. The rack 80 is, for example, integrally formed with the inner wall of the gear housing portion 24*a* of the right-hand casing 24 and meshes, for example, with the travelling gear 59*a*. The rack 80 has, for example, two teeth, the center root between these teeth being disposed at a midway position which is half (about 19 degrees) of the swing angle (38 degrees) defined between the forward position A and the turn position B. The remaining construction is the same as that of the above described embodiment.

FIGS. 17(*a*), 17(*b*) and 17(*c*) illustrate operations starting from forward driving to reach the turn operation.

First, as shown in FIG. 17(*a*), in a condition in which the travelling gear assembly 48 is in the forward position, when the motor gear 44 driven by the motor 42 is rotated in the turn direction, i.e. direction D, the travelling gear assembly 48 begins to travel in the same direction D as that of the motor gear 44. Then, as shown in FIG. 17(*b*), when the travelling gear assembly 48 reaches its neutral position (as in FIG. 15), the travelling gear assembly 48 is completely de-meshed from the first and second drive gears 34, 52 and has its travelling gear 59*b* meshed with the rack 80; this meshing of the rotating gear 59*b* with the stationary rack 80 then forcibly drives the travelling gear assembly 48 along an arc forwardly towards the turn position B. Finally, as shown in FIG. 17(*c*), the travelling gear assembly 48 having been pushed forwardly by the rack 80 then meshes with the first and second intermediate gears 30, 50, which enables the vehicle toy to shift without fail from forward driving to the turn operation (with one caterpillar being driven forwardly and the other in reverse).

When the operation of the vehicle toy shifts from the turn operation to forward driving, the above operations of FIG. 17 are performed in reverse sequence In the construction just described above, when the travelling gear assembly 48 travels arcuately in the shifting operation, as the rack 80 is disposed in the neutral position, this rack 80 meshes with the travelling gear assembly 48 and forcibly pushes the latter outward to ensure that the shifting operation is smoothly performed without fail. Without the rack 80 there could be the following disadvantages that: when the operation of the vehicle toy shifts to the forward driving or to the turn operation, i.e. when it is tried to have the first 34 and second 52 drive gears (which are rotated in directions opposite to each other) or the first 30 and the second 50 intermediate gears mesh with the travelling gear assembly 48 under the influence of the torque developed in the motor 42, the gears may fail to be meshed with the travelling gear assembly 48 since the gears are different in rotational direction from each other and therefore may repel each other; and a long period of time may be required before rotational speeds of the first and second intermediate gears 30, 50 are so decreased as to make it possible to have the gears mesh with each other, which may cause the vehicle toy to perform unnatural operations such as overrunning under the influence of inertia and like operations. As a countermeasure to such problems, there is a method for having a planetary gear biased by means of a compression spring in a transmission mechanism (which uses the planetary gear) so as to have the gear be readily swung in the rotational direction under the influence of the torque developed in the motor. However, this method is poor in reliability in gear-meshing operation, and, therefore it is not adequate for gears being rotated at a high speed. Further, in the above method, there is employed a biasing force which results in disadvantages such as a speed loss, electric-current loss and shortened battery life. In the embodiments of the present invention described above, the provision of the rack 80 enables the shifting operation to be performed without fail and the driving operation to be appropriate and natural.

In the above embodiments of the present invention, although a vehicle toy provided with caterpillars has been described as an example, it is also possible to use the drive unit having the above construction as a drive unit for a conventional four-wheeled vehicle toy. Further, although the example in which the rear left-hand and the rear right-hand wheel are driven has been described, the drive unit performs the same action as that of the above when it drives a front left-hand and a front right-hand wheel.

Further, in each of the above described embodiments, it is sufficient for the present invention to construct the travelling gear assembly 48 so as to have the same travel along a path between the forward position and the turn position under the influence of at least the motor gear 44 driven by the motor 42, directly drive the drive gears 34, 52 in the forward position, and drive the drive gears 34, 52 through the intermediate gears 30, 50 and the idler gear 32 in the turn position. It is also sufficient for the present invention that when the travelling gear assembly 48 is moved to the turn position, the compound gear 48 is meshed with gears such as the intermediate gears 30, 50 and the like to have the reduction ratio of the gears larger than that in the forward drive position, and use the idler gear 32 in mesh between the gears to have the gears rotate in directions opposite to each other. Consequently, there is no limitation in the arrangement of the gears, the number of the gears, and in the number of teeth of each gear.

Further, although the motor 42 is disposed in the side of the right-hand casing 24 in the above embodiments, it is also possible to dispose the motor 42 in the side of the left-hand casing 24. Further, in the above embodiments, although the example of the right turn has been described, it is alternatively feasible to arrange for a left turn.

Furthermore, although the example of a rack 80 with two teeth has been described, it is also possible for the rack 80 to have any desired number of teeth, provided that the rack 80 with such desired number of teeth can forcibly push the travelling gear 48 out of the neutral position.

As described above, according to the present invention, the travelling gear arrangement meshed with the motor gear travels along a path between the forward position and the turn position depending upon the rotational direction of the motor so that (i) in the forward position, the travelling gear is meshed with the first and second drive gears to directly drive the same; and (ii) in the turn position, the travelling gear is meshed with the first and second drive gears through the first and second intermediate gears and the idler gear to have the first and second drive gears rotate in directions opposite to each other, whereby the reduction ratio of the gears increases by means of the first and second intermediate gears to realize a lower-speed gearing in the turn operation than the gearing in the forward driving. This, therefore, realizes a high-speed performance in the forward driving and a large-torque performance in the turn operation to improve the vehicle toy in operability and in battery life. Further, by using the rack (which is meshed with the travelling gear assembly) in an intermediate position between the forward position and the turn position, it is possible for the travelling gear assembly to be forcibly moved outward even when the travelling gear assembly is in the neutral position, which makes it possible to have the gears mesh with each other without fail.

The above described embodiments, of course, are not to be construed as limiting the breadth of the present invention. Modifications, and other alternative constructions, will be apparent which are within the spirit and scope of the invention as defined in the appended claims.

I claim:

1. A drive unit of a vehicle toy, comprising:

a motor;

a motor gear driven in forward and reverse directions of rotation by said motor;

first and second drive gears for independently driving left and right wheels of the vehicle toy;

first and second intermediate gears for reducing in rotational speed said first and second drive gears;

an idle gear meshed with one of said first and second intermediate gears to cause said first and second drive gears to be rotated in directions opposite to each other;

a travelling gear meshing with said motor gear and driven by said motor gear to travel along a path between a forward-drive position and a turn-drive position depending on the rotational direction of said motor gear;

said travelling gear being mounted to move along an arcuate path with gear means for selectively engaging one of said first and second drive gears and said first and second intermediate gears dependent upon motor direction;

said travelling gear directly driving both said first and second drive gears in the same direction at a first gear ratio in said forward-drive position; and said travelling gear driving said first and second drive gears in opposite directions at a second gear ratio higher than said first gear ratio through said first and second intermediate gears and said idler gear in said turn-drive position to effect driving of the wheels through an increased reduction ratio during turning of the vehicle than when the vehicle is being driven forward.

2. The drive unit of claim 1, further comprising a fixed arcuate rack disposed in an intermediate position between said forward-drive position and said turn-drive position, said travelling gear meshing with an engaging said rack as said travelling gear travels along said path.

3. The drive unit of claim 1, wherein said travelling gear is mounted on an arm pivotal about said motor gear.

4. A drive unit of a vehicle toy, comprising:

a motor;

a motor gear driven in forward and reverse directions of rotation by said motor;

first and second drive gears for independently driving left and right wheels of the vehicle toy;

first and second intermediate gears for reducing in rotational speed said first and second drive gears;

idle gear meshed with one of said first and second intermediate gears to cause said first and second drive gears to be rotating in directions opposite to each other;

a travelling gear meshing with said motor gear and driven by said motor gear to travel along a path between a forward-drive position and a turn-drive position depending on the rotational direction of said motor gear;

said travelling gear directly driving both said first and second drive gears in said forward-drive position;

said travelling gear driving said first and second drive gears through said first and second intermediate gears and said idler gear in said turn-drive position; and said travelling gear comprising a planetary gear in constant mesh with said motor gear, and two further gears on each side of and coaxial with said planetary gear, said further gears moving into and out of mesh with said drive gears and said intermediate gears.

5. A vehicle toy, comprising:

a body with left and right wheels mounted respectively on left and right sides of said body;

a reversible motor;

a motor gear driven by said motor;

first and second drive gears for independently driving the left and right wheels;

first and second intermediate reduction gears connected to said first and second drive gears, respectively;

an idler gear meshed with one of said first and second intermediate gears to enable said first and second drive gears to be rotated via said intermediate gears in directions opposite to each other;

a travelling gear arrangement with gear means in constant mesh with said motor gear and driven by said motor gear to travel in either direction along an arcuate path between a forward-drive position and a turn-drive position depending on the rotational direction of said reversible motor;

said travelling gear arrangement being mounted on a swing arm;

said travelling gear arrangement driving said first and second drive gears in the same rotational direction when in said forward-drive position;

said travelling gear arrangement, when in said turn-drive position, driving said first and second drive gears in opposite rotational directions through said first and second intermediate gears and said idler gear; and said travelling gear arrangement gear means when in said turn-drive position driving said first and second drive gears via said intermediate reduction gears at a higher reduction ratio than when in said forward-drive position, said intermediate reduction gears being inoperative in driving said first and second drive gears in said forward-drive position.

6. A vehicle toy, comprising:

a body with left and right wheel mounted respectively on left and right sides of said body;

a reversible motor;

a motor gear driven by said motor;

first and second drive gears for independently driving the left and right wheels;

first and second intermediate gears connected to said first and second drive gears, respectively;

an idler gear meshed with one of said first and second intermediate gears to enable said first and second drive gears to be rotated in directions opposite to each other;

a travelling gear arrangement in constant mesh with said motor gear and driven by said motor gear to travel in either direction along an arcuate path between a forward-drive position and a turn-drive position depending on the rotational direction of said reversible motor;

said travelling gear arrangement driving said first and second drive gears in the same rotational direction when in said forward-drive position;

said travelling gear arrangement, when in said turn-drive position, driving said first and second drive gears in opposite rotational directions through said first and second intermediate gears and said idler gear; and a toothed rack fixedly disposed in an intermediate position between said forward-drive position and said turn-drive position, said travelling gear assembly meshing with said rack as said travelling gear travels along said path.

7. The vehicle toy of claim 6, wherein said motor gear is rotatable about a central axis, said rack is arcuate, and said path and said rack are concentric about said axis.

8. The vehicle toy of claim 6, further comprising left and right endless tracks driven by said left and right wheels, respectively.

9. The vehicle toy of claim 6, wherein said travelling gear assembly pivots about said motor gear between two stops which determine said forward-drive and turn-drive positions.

10. A vehicle toy, comprising:

a body with left and right wheels mounted respectively on left and right sides of said body;

a reversible motor;

a motor gear driven by said motor;

first and second drive gears for independently driving the left and right wheels;

first and second intermediate gears connected to said first and second drive gears, respectively;

an idler gear meshed with one of said first and second intermediate gears to enable said first and second drive gears to be rotated in directions opposite to each other;

a travelling gear arrangement in constant mesh with said motor gear and driven by said motor gear to travel in either direction along an arcuate path between a forward-drive position an a turn-drive position depending on the rotational direction of said reversible motor;

said travelling gear arrangement driving said first and second drive gears in the same rotational direction when in said forward-drive position;

said travelling gear arrangement, when in said turn-drive position, driving said first and second drive gears in opposite rotational directions through said first and second intermediate gears and said idler gear; and said travelling gear assembly comprising a central planetary gear in mesh with said motor gear, two first reduction gears coaxially disposed on one side of said planetary gear, and two second reduction gears coaxially disposed on the opposite side of said planetary gear.

11. The vehicle toy of claim 10, wherein said two first reduction gears are respectively brought into mesh with said first drive gear in said forward-drive position and said first intermediate gear in said turn-drive position, and said two second reduction gears are respectively brought into mesh with said second drive gear in said forward-drive position and said second intermediate gear in said turn-drive position.

12. The vehicle toy of claim 11, wherein the two first reduction gears are of different sizes, and the two second reduction gears are the same sizes as the two first reduction gears, the reduction ratio between said motor gear and each drive gear being greater in said turn-drive position for turning said vehicle toy than in said forward-drive position for driving said vehicle toy forward.

13. The vehicle toy of claim 10, wherein said motor is radio controlled.

* * * * *

UNITED STATES PATENT AND TRADEMARK OFFICE

CERTIFICATE OF CORRECTION

PATENT NO. : 5,273,480
DATED : December 28,1993
INVENTOR(S) : Shohei Suto

It is certified that error appears in the above-identified patent and that said Letters Patent is hereby corrected as shown below:

Title page, at [54], insert --REMOTE-- at the beginning of the title before "CONTROL".

Claim 1: in column 11, line 23, change "idle" to --idler--.

Claim 4: in column 11, line 65, insert --an-- before "idle" and change "idle" to --idler--;

in column 11, line 67, change "rotating" to --rotated--.

Claim 6: in column 12, line 57, change "wheel" to --wheels--;

in column 13, straddling lines 17 and 18, change "assembly" to --arrangement--;

in column 13, line 18, insert --arrangement-- after "gear".

Claim 9: in column 13, line 28, change "assembly" to --arrangement--.

UNITED STATES PATENT AND TRADEMARK OFFICE

CERTIFICATE OF CORRECTION

PATENT NO. : 5,273,480

DATED : December 28,1993

INVENTOR(S) : Shohei Suto

It is certified that error appears in the above-identified patent and that said Letters Patent is hereby corrected as shown below:

Claim 10: in column 14, line 17, change "assembly" to --arrangement--.

Signed and Sealed this

Twenty-first Day of June, 1994

Bruce Lehman

*Attest:*

BRUCE LEHMAN

*Attesting Officer*

*Commissioner of Patents and Trademarks*